US006772473B2

(12) United States Patent
Dubos et al.

(10) Patent No.: US 6,772,473 B2
(45) Date of Patent: Aug. 10, 2004

(54) WASTE COLLECTING CONTAINER FOR VACUUM CLEANER

(75) Inventors: Roland Dubos, Richeville (FR); Gilles Diascorn, Vernon (FR)

(73) Assignee: SEB S.A., Ecully (FR)

( * ) Notice: Subject to any disclaimer, the term of this patent is extended or adjusted under 35 U.S.C. 154(b) by 176 days.

(21) Appl. No.: 10/031,119

(22) PCT Filed: May 15, 2001

(86) PCT No.: PCT/FR01/01461

§ 371 (c)(1),
(2), (4) Date: Jan. 16, 2002

(87) PCT Pub. No.: WO01/87131

PCT Pub. Date: Nov. 22, 2001

(65) Prior Publication Data

US 2002/0120998 A1 Sep. 5, 2002

(30) Foreign Application Priority Data

May 16, 2000 (FR) ..... 00 06239

(51) Int. Cl.[7] ..... A47L 9/10; A47L 9/12
(52) U.S. Cl. ..... 15/353; 15/327.1
(58) Field of Search ..... 15/344, 350, 351, 15/352, 353, 327.1, 327.2, 327.6, 327.7; 55/429, 456, 457

(56) References Cited

U.S. PATENT DOCUMENTS 4,278,456 A * 7/1981 Hug ..... 55/429
5,787,546 A * 8/1998 Bass et al. ..... 15/344
5,846,273 A 12/1998 Dyson
5,935,279 A 8/1999 Kilström
6,026,540 A 2/2000 Wright et al.
6,189,178 B1 * 2/2001 Roberts ..... 15/323
6,332,239 B1 12/2001 Dubos et al.

FOREIGN PATENT DOCUMENTS

| | | | |
|---|---|---|---|
| EP | 0 885 585 A1 | | 12/1998 |
| FR | 2 778 546 A1 | | 11/1999 |
| JP | 52-22371 | * | 2/1977 |
| JP | 3-131217 | * | 6/1991 |
| JP | 8-140908 | * | 6/1996 |
| JP | 9-192056 | * | 7/1997 |
| WO | WO 96/27446 A1 | | 9/1996 |

* cited by examiner

*Primary Examiner*—Terrence R. Till
(74) *Attorney, Agent, or Firm*—Browdy and Neimark, P.L.L.C.

(57) ABSTRACT

Removable container (1, 44) for collecting waste (8) separated by a cyclonic or inertial device (12, 22, 31) for a waste collecting appliance of the vacuum cleaner type, the container having several walls (2, 4, 6, 45*a,* 45*b,* 46, 48, 50) delimiting a storage volume (10, 54), including a base wall (2, 46) forming the base of the container (1, 44), and at least one link wall (4, 48) provided with an opening (5, 49). The base wall (2, 46) and the link wall (4, 48) are contiguous with one another while presenting either a curve of one and/or the other wall, or an inclination between the walls, and the opening (5, 49) of the link wall (4, 48) is located in immediate proximity to the zone of contiguity between the link wall and the base wall (2, 46).

14 Claims, 5 Drawing Sheets

WASTE COLLECTING CONTAINER FOR VACUUM CLEANER

REFERENCE TO RELATED APPLICATIONS

The present application is the national stage under 35 U.S.C. 371 of international application PCT/FR01/01461, filed May 15, 2001 which designated the United States, and which international application was published under PCT Article 21(2) in the English language.

The present invention concerns a waste collecting device intended to equip a vacuum cleaner having a system for separation of the waste of the inertial type or by a cyclone.

Such devices and the advantages that flow therefrom are known: on the one hand an absence of filter bags collecting the waste, bags that it is necessary to change regularly requiring a repetitive purchase of said bags, and on the other hand aspiration conditions that are more constant over time and thus are more favorable to the useful life of the motor and to the effectiveness of the dust removal.

These devices thus generally comprise a shell having an interior tube. The air introduced often tangentially at the interior of the shell follows a helical descending path around the tube while projecting solid particles against the internal face of the wall, these particles then being collected by gravity along the wall in a lower receptacle. At the end of the spiral, air that is liberated from the solid particles rises in the central tube.

The document WO 96/21389 describes a vacuum cleaner of this type that is more elaborate in comprising two cyclones provoked in two concentric casings.

The finest and thus the lightest particles are mainly carried by the flux in the central tube, the centrifugal forces evoked at a higher level playing, with respect to said particles, only a secondary role with respect to the entrainment forces. The majority of these particles do not separate from the air flux and are recovered downstream of the device by means for example of a filter composed of a pleated media.

A residual part of the fine particles is received in the waste receptacle while this fine dust should not be separated by the cyclonic device. This observation can be explained by the fact that one part of the fine dust remains coupled to the more voluminous waste, by mechanical attachment or by surface forces of the electrostatic type. Moreover, when the fine dust is already localized at the periphery of the air flux during its entry into the separation device, the probability of collecting it in the waste container is greater than the probability of a particle of the same size located more axially in the entering flux.

The lower waste receptacle must be emptied regularly. One part of the flow of air having a tendency to penetrate to the interior of the receptacle, this receptacle is often given large dimensions, for the purpose of arriving at storing particles sufficiently far from the flow of air penetrating into the receptacle, in order that the waste is not re-entrained to the exterior of said receptacle. These large dimensions also permit the receptacle to be emptied less often.

According to a simple form of construction, as presented in the document WO 96/27446, the separation device is a vertical cyclonic device, the waste collecting container being then situated under the separation device. Thus, separated waste is accumulated in the lower part of the cyclone, at the level of the inversion of the air flow, and is entrained into the container by inertial projection, the accumulation of waste in the container being aided by gravity, a consequence of the vertical disposition of the cyclonic device.

In other cases, where the separation device is not disposed according to a preferred orientation, such as that described in the document FR 2 778 546, said container is situated on the path of air placed in rotation by the waste separation device. Preferably, the container is situated at the periphery of the separation device, in this case by centrifuging with the aid of a screw, in such a manner that a minimum of air and a maximum of waste are introduced into the container, the waste possibly being halted by a retaining grid. This waste is thus accumulated in the collecting container.

In these two cases, the container has the general form of a box, with or without the presence of a lid.

If, certainly, this separation offers the advantage of freedom from the vacuum cleaner bags of the more conventional appliances, it necessitates however a regular emptying of the waste container.

This operation of emptying and above all of cleaning the waster collecting container is found to be burdensome and incomplete when elements making up the filter device are housed at the interior of the colleting container. Thus, in the document U.S. Pat. No. 5,935,279, the waste collecting container is removable and is provided with a gripping handle. It has, moreover, two separation devices, one with a perforated wall, the other with a cyclonic device, elements that can however be removed from the container for emptying and/or cleaning of said container. These emptying and cleaning operations are thus not very easy to carry out, since they require a disassembly of constituent parts of the receptacle and parts associated principally with separation of the waste.

One of the objects of the present invention is to reduce the problems of handling and complexity of waste collecting containers of the devices of the prior art and thus to improve the comfort of utilization of vacuum cleaners with waste separation of the cyclonic or centrifuging type.

Another object of the invention is to provide the user with a receptacle that can be emptied in a careful and controlled manner while minimizing the quantity of fine dust that escapes and flies around the receptacle and the waste bin.

The present invention is achieved with the aid of a removable waste collecting container separated by a device of the cyclonic or inertial type for a waste collecting appliance of the vacuum cleaner type, said container having several walls delimiting a storage volume, among said walls are noteworthy a wall forming the base of the container, called the base wall, as well as at least one wall provided with an opening, called the link wall, characterized in that:

- the base wall and the link wall are contiguous while presenting either a curve of one and/or the other wall, or an inclination between said walls,
- the opening of the link wall is located in immediate proximity to the zone of contiguity between said wall and the base wall.

By this inclination or curve between the base and link walls, the container is given the form of a pouring spout, so that it is easy to empty waste through the opening provided in the link wall, an operation facilitated by the location of the emptying opening closest to the base wall.

The user can thus control the exit of the waste by giving an inclination which is just sufficient to allow the dust to begin to slide without reaching a significant speed which would lead to the fine dust, which is necessarily found in the container, becoming airborne.

According to a preferred embodiment of the invention, the removable waste collecting container is in communication over an air path with the waste separating device through the opening of the link wall when it is disposed within the aspiration system.

This arrangement permits the provision of two openings within the container to be avoided: a first to cause the waste to penetrate to the interior of the container, as well as a second opening for emptying the container.

Advantageously, the internal volume of the waste collecting container for storing waste is not provided with any piece, conduit, or device for waste separation.

It is an effect important to note that most of the waste collecting containers have one part of the device for separation of waste, so that the emptying of the container requires either a partial removal of said part, a removal which is distasteful, or the near impossibility of correct cleaning of the container. By making the container removable and with a continuous interior volume, the cleaning of said container is facilitated, as is the convenience of use of the vacuum cleaner.

In a preferred manner, the waste collecting container has a handle situated on one of the walls other than the link wall and the base wall, said handle being located at the outside of the volume defined by said container in order to facilitate gripping of the container.

According to one of the preferred embodiments, the base wall is substantially flat. This flatness permits the speed of sliding of the homogeneous dust to be maintained, minimizing turbulences that are likely to cause the dust to become airborne.

In order to perfect this sliding of the dust smoothly and without turbulence, the base wall is smooth, either by a particular molding, or by a specific surface treatment, including deposition of an non-stick layer such as PTFE.

Advantageously, according to this latter embodiment, the link wall is equally substantially flat, said base and link walls being inclined with respect to one another by an angle of between 40° And 70°. This angular range corresponds to an optimum between the ease of emptying the waste from the container and the bulk of said container.

According to a variant of construction, the container has, outside of the waste storage volume, a conduit for return of purified air. This conduit permits an improvement in overall compactness of the appliance, by avoiding bypassing the waste storage container.

According to this variant of construction, advantageously, the conduit opens:

at one of its ends into the link wall, at the other end into the base wall.

In a preferred manner, in this latter variant, one part of the wall or walls of the conduit is common with the walls delimiting the waste storage volume, permitting an improvement in material and costs, the common parts being created during the operation of molding of the walls of the container.

Another aspect of the invention concerns a removable waste collecting container such as described previously and having a lid disposed on the link wall, said lid having an opening communicating with the opening of the link wall.

The use of a lid, being able to be open for permitting an easy access to the waste storage volume, improves the ease of cleaning of the walls delimiting said volume.

Preferably, the area of the opening of the lid is at least less than one quarter of the area of the opening of the wall, the zone of coverage of the opening of the link wall being essentially situated toward the zone of contiguity of the link and base walls. Thus, this permits the waste container to be partially obstructed, which facilitates storage of the waste by reducing the opening of the container toward the outside.

Preferably, the lid or a part of the lid is mounted to pivot about an axis that is spaced from the zone of contiguity, in order to facilitate emptying of the container when this latter is inclined toward a dust bin for example, since the lid can then pivot, permitting the waste to fall into the dust bin through the opening present in the link wall and freed by the lid.

According to one of the embodiments, the lid has at least one joint which is peripheral to the openings, on one or the other of its faces, permitting a good seal with the air flow conduits to be guaranteed.

The aim of the present invention is equally a waste separation device of the inertial or cyclonic type for an electrical appliance of the vacuum cleaner type, said device having a first tube presenting an air inlet orifice capable of receiving air that is aspirated and led by the tube, and an air return orifice, a screw positioned in an axial manner in this first tube, a second tube having a diameter smaller than the outer diameter of the screw and situated coaxially in the extension of the first tube, in communication over an air path by one end to the return flow end of the first tube and connected by its other end to the suction group by a first evacuation conduit, a third tube arranged around the second tube and connected to the return flow end of the first tube in a manner to arrange between the second and the third tube a second conduit for evacuation of waste toward a collecting container, characterized in that it has a container as previously described.

By using a device for separation of waste composed of a screw within a particular arrangement of tubes, it is possible to dispose the separation system according to any orientation, as well vertical as horizontal or in an oblique manner.

Preferably, taking into account the inclination between the link wall and the base wall, the screw and the first, second and third tubes are substantially parallel to the link wall of the waste collecting container, facilitating the introduction of waste into the container, as well as the general conception of the vacuum cleaner, avoiding dead zones that would increase the bulk of the appliance.

BRIEF DESCRIPTION OF THE DRAWINGS

The description hereafter makes reference to the attached drawings, given by way of non-limiting examples, among which.

DETAILED DESCRIPTION OF THE DRAWINGS

Figure 1:
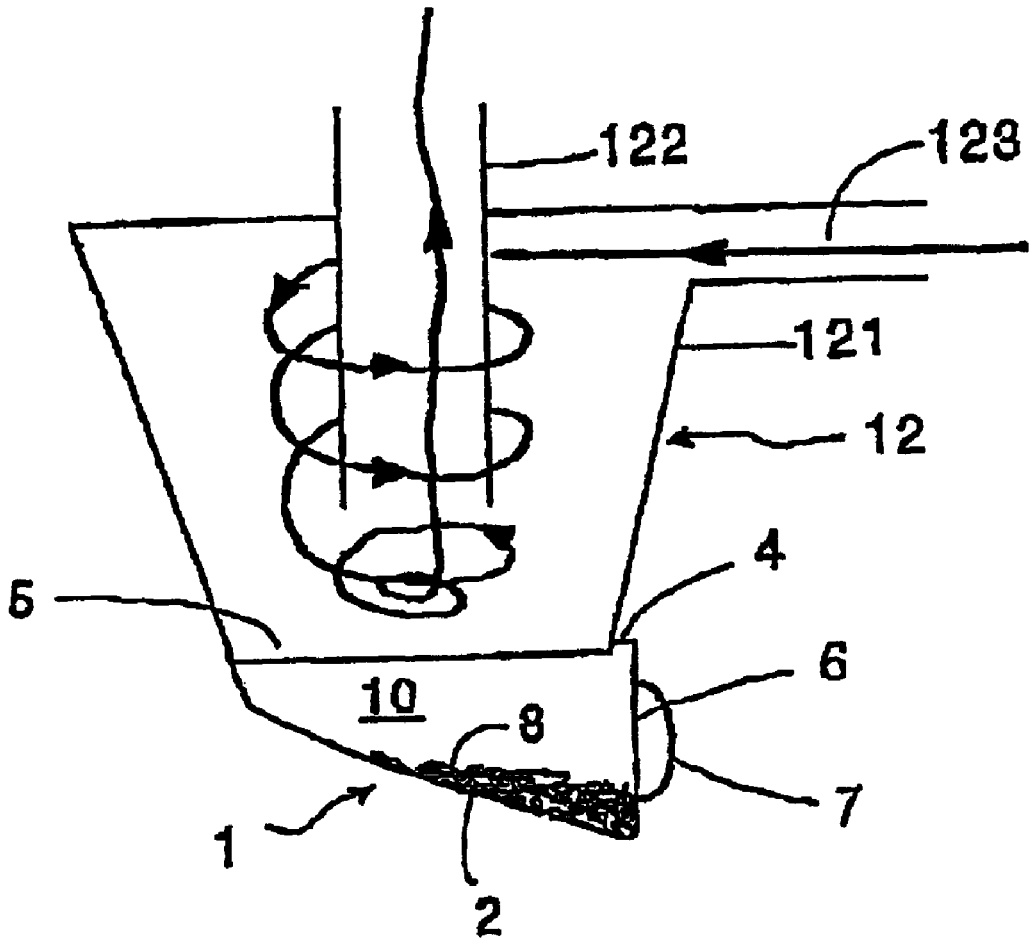
FIG. 1 presents a schema of the principle of the invention applied to a separator of the cyclonic type.

On FIG. 1 appears a device 12 for separation of waste of the cyclonic type comprising a frustoconic envelope 121 as well as a return flow tube 122. The aspirated air follows the overall trajectory 123, firstly helical descending along the frustoconic wall 121, then rising afterward along the central axis of the return flow tube 122.

Waste 8 separated by the cyclone is collected in a receptacle 1 situated in the lower part of the device, waste being deposited in the container by gravity and inertial projection. Air leaving therefrom is then loaded only with fine particles which are treated further downstream, if the application requires.

According to the invention, container 1 has a base wall 2 on which the waste is deposited, a link wall 4 having an opening 5, a wall 6 having a handle 7, as well as two lateral walls that are not shown, these walls delimiting a storage volume 10 for the waste. The opening in link wall 4 permits, on the one hand, waste to pass from the separation device to the container but equally emptying of the waste from the container when necessary. For this, opening 5 of link wall 4 is situated in the continuity of the truncation of the conical envelope 121 of the cyclonic device.

In order to offer a container that is simple and easy to use, it is provided that base wall 2 and link wall 4 are adjacent to one another, for example by a curved shape of base wall 2 such as shown. Other configurations can be envisioned in order to assure this contguity: curved shape of link wall 4, curved shape of the two base and link walls, inclination of the two walls, . . . . All of these configurations are present at the level of the internal wall, delimiting the storage volume, the container being able to present on the outside slightly different forms. In particular, the base wall can present an interior curvature and an exterior flatness for reasons of stability when the container is placed on a flat surface.

Moreover, opening 5 of link wall 4 extends to the end of said wall adjacent to base wall 2, in manner that, by this absence of an edge in link wall 4 at the level of the zone of contiguity as well as by the contiguousness between the base wall and the link wall, waste can easily slide on the base wall and be extracted from the container without encountering a wall limiting its exit. In addition, by the overall inclination of the base and link walls, it is not necessary to invert or turn over the container in order to empty it.

Handle 7 facilitates removal of the container as well as emptying thereof. It preferably located at the exterior of a wall, opposite the zone of contiguity.

Figures 2A, 2B:
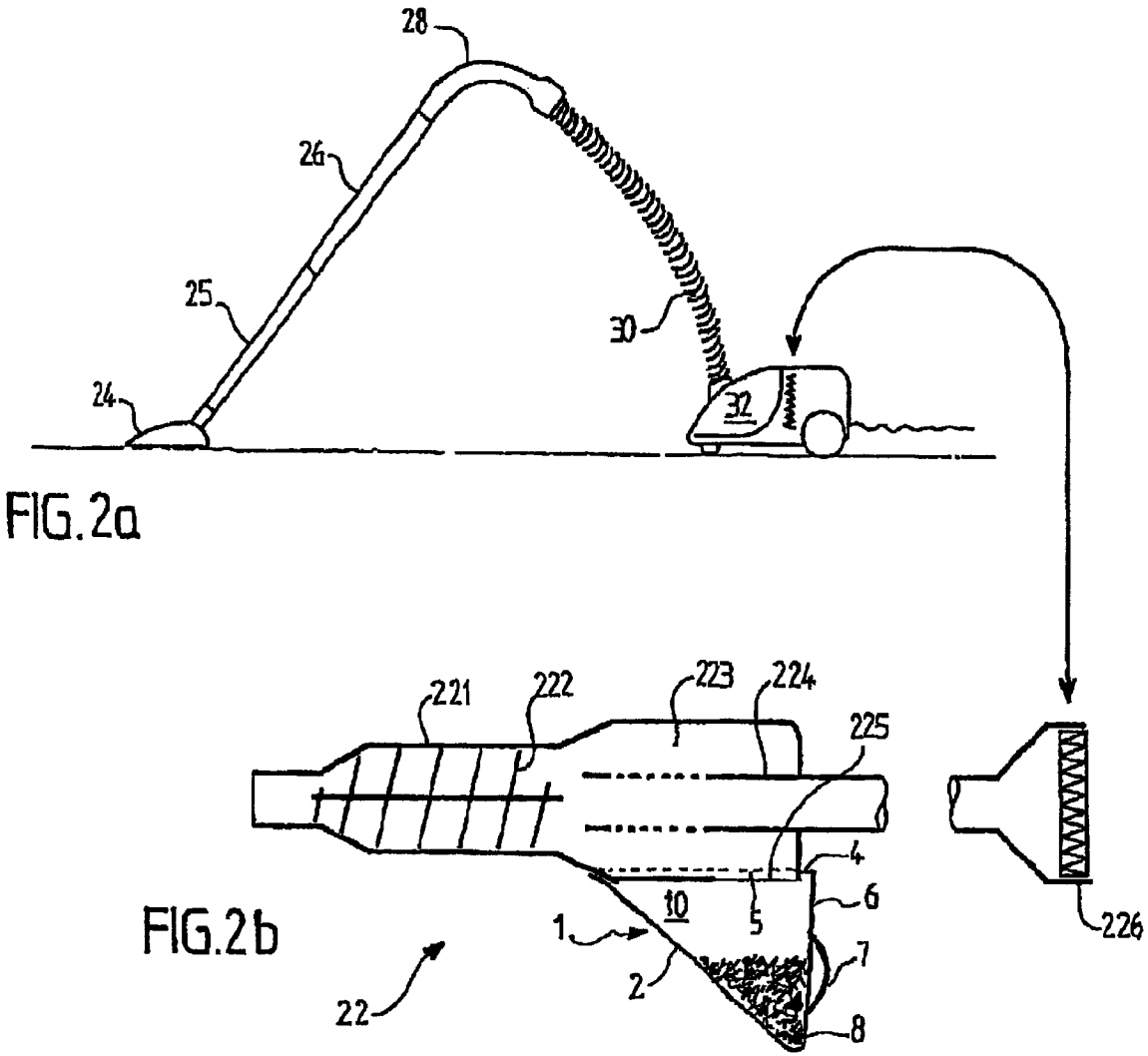
FIG. 2*a* is a schematic overall view of a complete aspiration chain within a vacuum cleaner.
FIG. 2*b* presents the embodiment of the invention on a device for separation by inertia.

FIGS. 2*a* and 2*b* present an example of application of a waste collecting container according to the present invention to a device for separating waste of the inertial type.

FIG. 2*a* presents a complete aspiration chain. In following the air flow circuit, air penetrates through suction nozzle 24, then into extension tubes 25, 26, follows a path into handle 28, then into hose 30, to end in casing 32 where the waste collecting container is usually placed.

In place of the conventional dust bag there is placed a waste separation device 22 of the inertial type where air loaded with waste is placed in rotation with the aid of a screw, such as shown in FIG. 2*b*. Introduction of air is effectuated along the main axis of the tube 221 at one end of this latter. Upon arrival at screw 222, the flow becomes helical, projecting, therefore, solid particles on the internal wall of tube 221. When screw 222 is passed, the flow of air is divided into two branches, the first, main, conducts air from which dust has been removed toward a main return flow tube 224, the second evacuates dust and waste which continue their helical movement into the space 223, up to the additional return flow orifice 225.

This orifice is in communication with opening 5 provided in link wall 4 of the waste collecting container, a hermetic container. The additional evacuation flow rate being mainly due to the kinetic energy acquired upstream by the particles, energy sufficient for the transport up to the adjacent receptacle, the air movements are less turbulent in this zone than in the upstream circuit, in such a manner that a simple opening can be sufficient for recovery of the waste.

It can, however, be provided, when the air flow is too substantial at the level of the container, to complete the opening with a grid permitting retention of voluminous and light waste preliminarily centrifuged and separated from the main air flow.

In order to perfect the general filtration of the device, a filter 226 is placed downstream for the treatment of fine waste. It can, as in the figure, be placed in the body of the appliance. It can be presented in the form of a conventional fabric or paper bag, or a flat or pleated filter, . . . .

The use of a screw, within a particular arrangement of tubes, permits a greater latitude in the disposition of the separation device at the interior of the body of the vacuum cleaner, as well vertically as horizontally, or with a particular inclination.

Thus, it can be provided to carefully combine the principle of contiguity of the base and link walls of the dust container with the freedom of inclination of the device for separating waste in order to provide a waste collecting container having a substantially horizontal base wall for the storage of waste.

Figure 3:
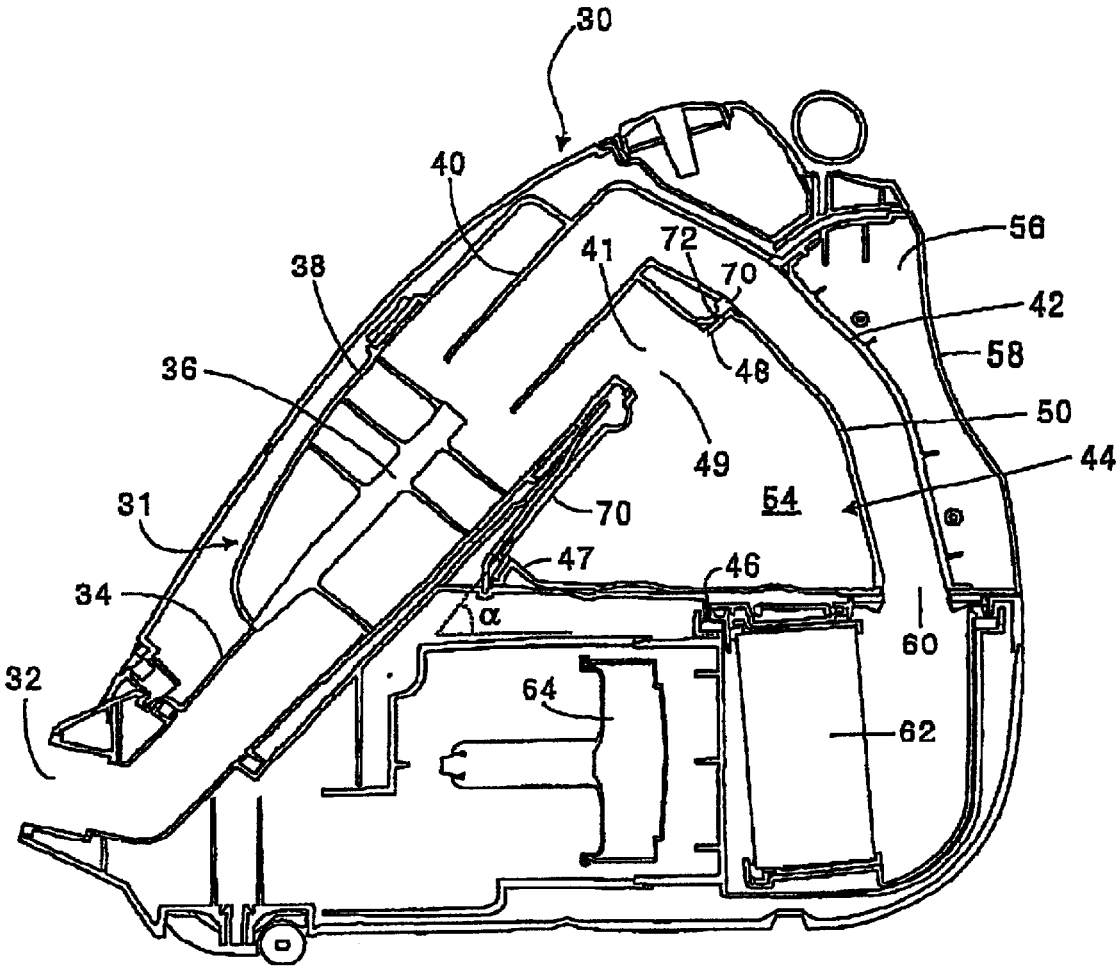
FIG. 3 is a cross-sectional view of a vacuum cleaner equipped notably with the present invention, according to a particular embodiment.

Such a structure is presented in FIG. 3 within a vacuum cleaner body 30. One finds, in the waste separation device 31, a conduit 34 for receiving waste that has been aspirated and penetrating into the body of the vacuum cleaner through the opening 32, a screw 36 mounted in cylindrical body 38. A tube 40 permits evacuation of purified air, while cylindrical body 38 has an opening 41 for evacuation of separated waste. The functioning of such a device is explained in greater detail in the patent FR 2 778 546 in the name of applicant.

A waste collecting container 44 completes the separation device. According to the invention, container 44 has a base wall 46, a link wall 48 adjacent to base wall 46, as well as a rear wall 50. Two lateral walls, 45*a* and 45*b*, visible in FIG. 4, thus permit a storage volume 54 to be defined. According to the invention, link wall 48 and base wall 46 are contiguous through an inclination and a curved part of link wall 48, completed by a curved part 47 of base wall 46.

Figure 4:
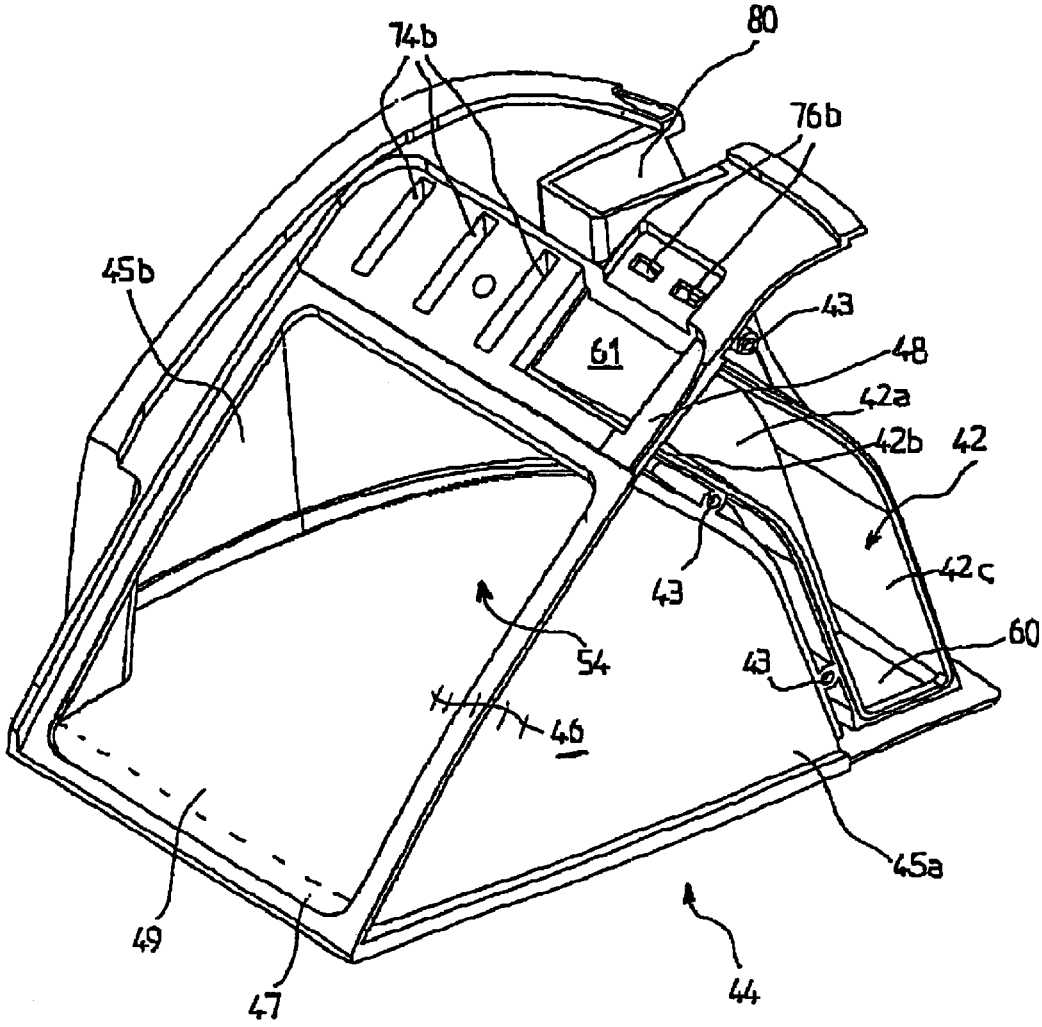
FIG. 4 is a perspective view of one of the possible forms of a waste container according to the embodiment of FIG. 3.

Moreover, an opening 49 is arranged in link wall 48, this opening extending to base wall 46, as is clearly visible in FIG. 4.

In order to have a substantially horizontal base wall in the vacuum cleaner body, link wall 48 has an overall inclination with respect to said base wall 46 and thus with respect to the horizontal, by an angle $\alpha$ of around 60.

As a result, separation device 31 is equally inclined substantially by the same angle in order that the passage of separated waste, into container 44, is achieved without an intermediate conduit. This arrangement also eliminates any dead zone between cylindrical body 38 and said container 44.

According to a particular form of construction of the invention illustrated in FIGS. 3 to 4, conduit 40 for evacuation of air that has been freed of waste has a bend and is extended by a conduit 42 passing through the waste container. This conduit opens, at 60, into a space having a filter 62 behind which is found the aspiration group 64.

FIG. 4 shows a perspective view of the waste container according to a particular embodiment. According to this latter, conduit 42 has two walls 42*a* and 42*b* in common with the walls delimiting the waste storage volume, each face of these common walls delimiting either the waste container, or the return flow conduit 42. The container equally has a third wall 42*c* of the conduit 42, an additional piece not shown, coming into the anchor points 43, in order to laterally close conduit 42.

The construction of a conduit traversing the collecting container, such as presented, can equally be envisioned when the waste separation device is of the cyclonic type.

Figure 5:
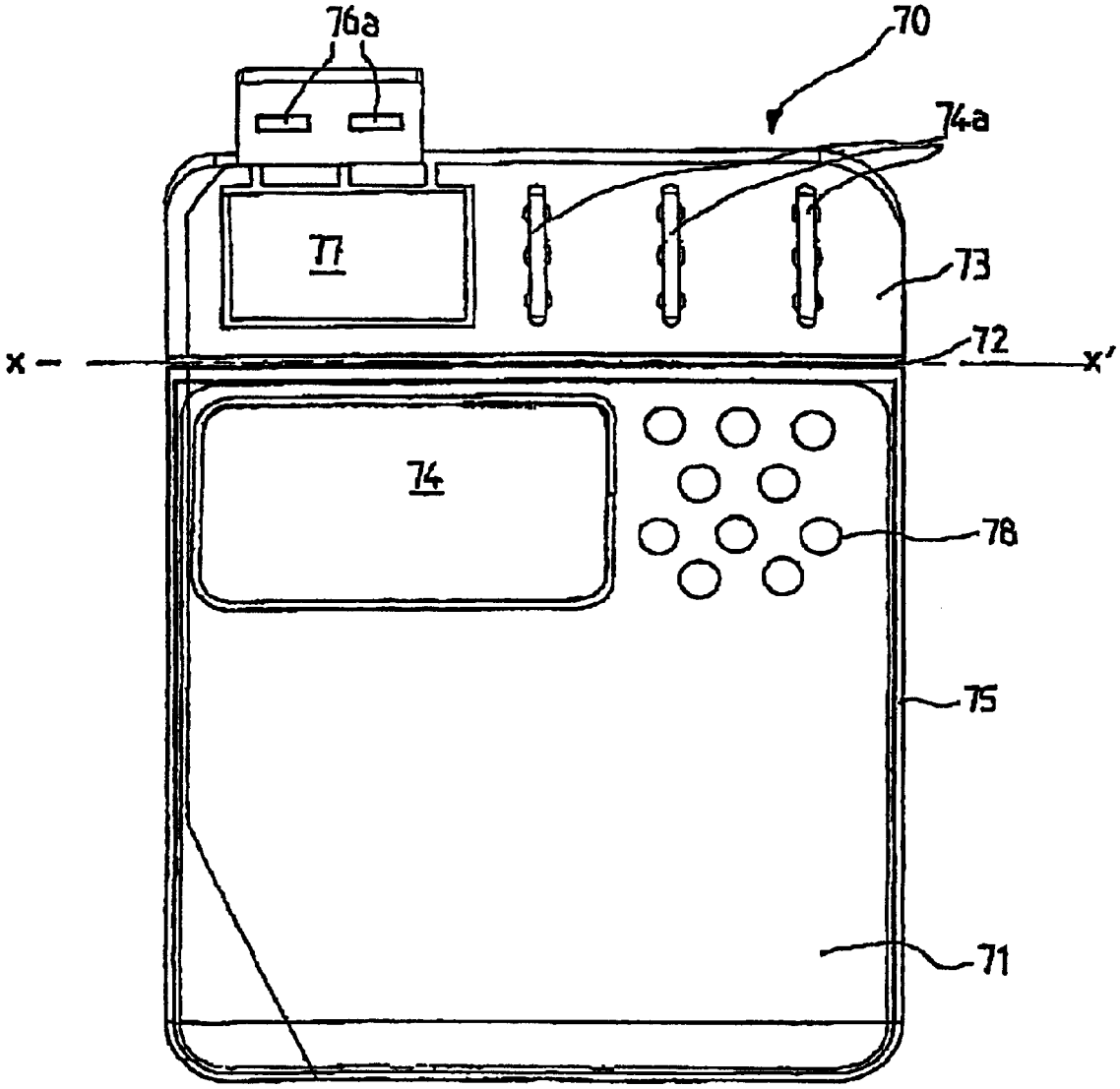
FIG. 5 presents a lid equipping a waste container as presented in FIG. 4.

Advantageously, container 44 has a lid 70 that comes to partly or completely cover the exterior face of connection wall 48. According to the example presented in FIG. 5, showing the interior face of the lid, this latter is composed of two parts, a part 73 permitting its attachment to container 44 and a part 71 for covering the opening 49 of the connection wall 48. An articulation 72, formed by a band of flexible material of the elastomer type, constituting in a certain manner a hinge, permits the covering part 71 to be able to pivot with respect to the axis x—x' constituted by band 72. Any other configuration permitting the lid or a part of the lid to pivot or to rock can be envisioned without departing from the framework of the invention. It is thus possible to conceive a lid articulated by mechanical hinges or having a transverse axis fixed in lateral walls 45*a*, 45*b*, for example.

The lid presents, in the covering part 71, an opening 74 permitting waste coming from separation device 31 to penetrate into the collecting container. Depending on the sense of rotation given to the waste, the opening is preferably situated eccentrically toward one of the lateral faces. In our case, the screw having a right-hand thread, waste in rotation arrives on link wall 48 while being close to lateral wall 45*a*, which justifies placement of opening 74 as represented. A similar reasoning can be used when the screw has a left-hand thread, the opening 74 then extending essentially along the wall 45*b* when the lid is mounted on the container.

Depending on the case, this opening can be completed with a multitude of holes 78 permitting light waste to be trapped and possibly re-entrained by the weak air flow penetrating at 74 into the container.

In order to guarantee a good seal, the lid is provided with a peripheral joint 75 around opening 49, coming to bear on link wall 48, or on the edge of walls 45*a*, 45*b* and 46 when the lid is disposed on said link wall 48. A joint can equally be disposed around opening 77, on the interior wall of the lid and/or on the exterior wall. Similarly, one can equally envision disposing a joint around opening 74, on the outside wall of the lid, in order to assure a seal with the waste separation device.

As is quite visible in FIGS. 4 and 5, opening 74 is much more reduced than opening 49 of the link wall. At a minimum, it represents 5% of the surface area of opening 49. At a maximum, the surface area of this opening represents 75% of the surface area of opening 49 in order for the lid to retain its function of covering opening 49, in playing to a certain extent, the role of a wall delimiting the storage volume.

Preferably, the surface area of the opening is between 5 and 25% of the surface area of the opening 49. By way of example, as shown in FIGS. 4 and 5, the surface area of opening 74 represents around 20% of the surface area of opening 49.

In any case, it is important that the waste inlet surface not be too large, in order to create a confinement of the waste without, however, being too small in order to prevent certain waste from being trapped in said opening. Thus, the cross-section of opening 74 is between 10 and 25 $cm^2$ and preferably around 20 $cm^2$.

Several solutions can be used to cause the lid to be maintained on link wall 48: mechanical assemblies with a screw, nuts, clips or glue . . . . The maintenance can equally be effectuated on walls 45*a* and 45*b* when they are utilized to create the axis of rotation of the lid.

In the example proposed, three holding clips 74*a* cooperate with three recesses 74*b* disposed on the exterior face of wall 48 in order to assure retention of the lid. The recesses, preferably, do not open into storage volume 54 of the container.

According to the example proposed, where the container equally has conduit 42 for flow of purified air, lid 70 has an opening 77 permitting the air flow continuity of conduits 40 and 42. In order to assure sealing at the level of this opening, two retaining clips 76*a* cooperate with two recesses 76*b* formed in the exterior of wall 48.

In order to facilitate grasping of the container, a handle, not shown, can be disposed to bear against the rear part 56 of the container, said part having a hollow zone 58, facilitating grasping of the container.

In order to guarantee an optimal functioning of the appliance, it can be envisioned that the waste container is translucent in order to be able to observe the degree of filling with dust. It is, in effect, important to guard against the receptacle becoming too full and consequently to empty it frequently. It can be harmful to the appliance to fill the waste receptacle too much since the waste can then be re-entrained by the air flow in the return flow tube, then representing a danger for the motor situated downstream of the tube.

The utilization of such a container, in the configuration represented in FIG. 3 is the following: lid 70 resting on link wall 48, maintained by the system of clips 74*a*, 74*b* and 76*a*, 76*b*, container 44 is introduced into the vacuum cleaner by taking hold of its handle, bottom wall 46 being substantially horizontal. By the inclination $\alpha$ of bottom and link walls 46, 48, an inclination taken up by the receiving walls of the receptacle, as well as the guiding of the lateral walls, the container comes to automatically occupy the good position within the vacuum cleaner, where opening 77 is in line with conduit 41, opening 74 in line with opening 41 arranged in the waste separation system, opening 60 with filter housing 62. The communication of the openings is completed, when it is present, by the sealing of the connection.

During operation, the separated waste penetrates into container 44 through opening 49, opening 74 in the lid limiting turbulence at the interior of the container and thus return of the dust toward the separation system. Purified air is entrained in conduits 41, then 42, passes into filter 62 then motor 64 before being evacuated.

Once the operation of waste collection is ended, the user withdraws container 44 by the handle, and transports it to a dustbin. Base wall 46 where the waste is received, being substantially horizontal in the vacuum cleaner, the user can then transport the container without handling of the container creating abrupt movements of the waste, which would have as a result to return the fine dust into suspension.

Above a dustbin, by slightly inclining the container toward the front, by the smooth surface of the base wall, the waste slides smoothly. The curved shape 47 permits the waste to avoid flowing quickly when it arrives at the outlet of the container, because then the curved shape 47 is substantially horizontal. This effect is similar to that of a toboggan having a substantially flat zone that avoids an abrupt drop by reduction of the speed.

At the same time, by the inclination given to the container, lid 70 pivots around axis 72, freeing opening 49 in order to permit the waste to leave the container and to fall into the dustbin, with a minimum of turbulence and thus with a minimum of fine dust being returned into suspension in the air, providing an obvious convenience of use. The absence of any interior piece is equally a factor limiting turbulence.

By the present invention, the user can, at his leisure, empty the waste collecting container, possibly at each time of use of the vacuum cleaner equipped with a waste separation device according the present invention. The simplicity of the interior volume intended to collect waste as well as the absence of any internal part permits an easy cleaning of the container. This latter can thus be emptied and cleaned with the aid of a cloth or by passing it under water, after each use, without the constraints of disassembly or of accessibility, providing a greater hygiene for the vacuum cleaner which can thus be put away after having been emptied of collected waste.

In order to provide an essentially ergonomic assistance for the placing of the container, the guide means of said container can be arranged on the housing and on the container. These means can consist of complementary sliding pieces, such as slide ways, or any other arrangement known per se to obtain a guiding of the two pieces, one of which is fixed and the other movable.

What is claimed is:

1. Removable container (1, 44) for collecting waste (8) separated by a device (12, 22, 31) of the cyclonic or inertial type for a waste collecting appliance of the vacuum cleaner type, said container having several walls (2, 4, 6, 45*a*, 45*b*, 46, 48, 50) delimiting a storage volume (10, 54), among said walls are noteworthy a wall (2, 46) forming the base of the container (1, 44), called the base wall, as well as at least one wall (4, 48) provided with an opening (5, 49), called the link wall, characterized in that:

the base wall (2, 46) and the link wall (4, 48) are contiguous in a zone of contiguity while presenting either a curve of one and/or the other wall, or an inclination between said walls, the opening (5, 49) of the link wall (4, 48) is located in immediate proximity to the zone of contiguity between said wall and the base wall (2, 46), characterized in that the base wall (2, 46) is substantially flat, the link wall (4, 48) is substantially flat, and said base (2, 46) and link (4, 48) walls are inclined with respect to one another by an angle ($\alpha$) of between 40° And 70°.

2. Removable container (1, 44) for collecting waste (8) according to claim 1, characterized in that it is in communication over an air path with the device (12, 22, 31) for separating waste (8) through the opening (5, 49) of the link wall (4, 48) when it is disposed within the waste collecting appliance.

3. Removable container (1, 44) for collecting waste (8) according to claim 1, characterized in that the internal volume (10, 54) of the waste collecting container (1, 44) for storing waste (8) is not provided with any piece, conduit, or device for waste separation.

4. Removable container (l, 44) for collecting waste (8) according to claim 1, characterized in that it has a handle (7) situated on one of the walls other than the link wall (4, 48) and the base wall (2, 46), said handle (7) being located at the outside of the volume defined by said container (1, 44).

5. Removable container (1, 44) for collecting waste (8) separated by a device (12, 22, 31) of the cyclonic or inertial type for a waste collecting appliance of the vacuum cleaner type, said container having several walls (2, 4, 6, 45*a*, 45*b*, 46, 48, 50) delimiting a storage volume (10, 54), among said walls are noteworthy a wall (2, 46) forming the base of the container (1, 44), called the base wall, as well as at least one wall (4, 48) provided with an opening (5, 49), called the link wall, characterized in that:

the base wall (2, 46) and the link wall (4, 48) are contiguous in a zone of contiguity while presenting either a curve of one and/or the other wall, or an inclination between said walls, the opening (5, 49) of the link wall (4, 48) is located in immediate proximity to the zone of contiguity between said wall and the base wall (2, 46), characterized in that said container has, outside of the volume (10, 54) for the storage of waste (8), a conduit (42) for return of purified air.

6. Removable container (1, 44) for collecting waste (8) according to claim 5, characterized in that said conduit (42) opens:

at one of its ends into the link wall (4, 48), at the other end into the base wall (2, 46).

7. Removable container (1, 44) for collecting waste (8) according to claim 5, characterized in that one part of the wall or walls (42*a*, 42*b*) of the conduit (42) is common with the walls delimiting the volume (10, 54) for the storage of waste (8).

8. Removable container (1, 44) for collecting waste (8) separated by a device (12, 22, 31) of the cyclonic or inertial type for a waste collecting appliance of the vacuum cleaner type, said container having several walls (2, 4, 6, 45*a*, 45*b*, 46, 48, 50) delimiting a storage volume (10, 54), among said walls are noteworthy a wall (2, 46) forming the base of the container (1, 44), called the base wall, as well as at least one wall (4, 48) provided with an opening (5, 49), called the link wall, characterized in that:

the base wall (2, 46) and the link wall (4, 48) are contiguous in a zone of contiguity while presenting either a curve of one and/or the other wall, or an inclination between said walls, the opening (5, 49) of the link wall (4, 48) is located in immediate proximity to the zone of contiguity between said wall and the base wall (2, 46), characterized in that said container has a lid (70) disposed on the link wall (4, 48), said lid (70) having an opening (74) communicating with the opening (5, 49) of the link wall (4, 48).

9. Removable container (1, 44) for collecting waste (8) according to claim 8, characterized in that the surface area of the opening (74) is between 5% and 25% of the surface area of the opening (5, 49) of of the link wall (4, 48).

10. Removable container (1, 44) for collecting waste (8) according to claim 8, characterized in that the cross-section of opening (74) of the lid (70) is between 10 $cm^2$ and 25 $cm^2$.

11. Removable container (1, 44) for collecting waste (8) according to claim 8, characterized in that the lid (70) or a part of the lid (70) is mounted to pivot about an axis (72) that is spaced from the zone of contiguity.

12. Removable container (1, 44) for collecting waste (8) according to claim 8, characterized in that the lid (70) has at least one joint (75) which is peripheral to the openings, on one and/or the other of its faces.

13. Device (12, 22, 31) for separation of waste (8) of the inertial or cyclonic type for an electrical appliance of the vacuum cleaner type, said device (12, 22, 31) having a first tube (38 221) presenting an air inlet orifice (32, 34) capable of receiving air that is aspirated and led by the tube, and an air return orifice, a screw (222, 36) positioned in an axial manner in this first tube (38, 221), a second tube (224, 40)

having a diameter smaller than the outer diameter of the screw (222, 36) and situated coaxially in the extension of the first tube (38, 221), in communication over an air path by one end to the return flow end of the first tube and connected by its other end to the suction group (64) by a first evacuation conduit (224, 42), a third tube arranged around the second tube and connected to the return flow end of the first tube in a manner to arrange between the second and the third tube a second conduit (223) for evacuation of waste toward a collecting container (1, 44), characterized in that the container (1, 44) has several walls (2, 4, 6, 45*a*, 45*b*, 46, 48, 50) delimiting a storage volume (10, 54), among said walls are noteworthy a wall (2, 46) forming the base of the container (1, 44), called the base wall, as well as at least one wall (4, 48) provided with an opening (5, 49), called the link wall, and further characterized in that:

the base wall (2, 46) and the link wall (4, 48) are contiguous in a zone of contiguity while presenting either a curve of one and/or the other wall, or an inclination between said walls, and the opening (5, 49) of the link wall (4, 48) is located in immediate proximity to the zone of contiguity between said wall and the base wall (2, 46).

14. Device (12, 22, 31) for separation of waste according to claim 13, characterized in that the screw (222, 36) and the first (38, 221), second (224, 40) and third tubes are substantially parallel to the link wall (4, 48) of the container (1, 44) for collecting waste (8).

* * * * *